United States Patent [19]

Helbig

[11] 4,296,959

[45] Oct. 27, 1981

[54] RACK HANGING DEVICE FOR GARMENTS

[76] Inventor: Rolf W. Helbig, 24-6679 Shelter Bay Rd., Mississauga, Ontario, Canada, L5N 2A2

[21] Appl. No.: 53,914

[22] Filed: Jul. 2, 1979

[51] Int. Cl.[3] ..... A47J 51/084

[52] U.S. Cl. ..... 294/143; 211/118; 248/340; 294/169

[58] Field of Search ..... 224/45 R, 45 T; 248/215, 304, 339, 340; 211/113, 118; 223/85, 88

[56] References Cited

U.S. PATENT DOCUMENTS

| | | | |
|---|---|---|---|
| 2,728,503 | 12/1955 | Kramer | 224/45 T |
| 3,317,055 | 5/1967 | Roscicki | 224/45 T |
| 3,633,801 | 1/1972 | Bonasso | 223/85 X |
| 3,633,802 | 1/1972 | Webster | 224/45 T |
| 3,692,218 | 9/1972 | Friedman | 224/45 T |
| 3,731,809 | 5/1973 | Saenger | 211/118 |
| 3,804,310 | 4/1974 | Wheeler | 224/45 T |
| 3,885,723 | 5/1975 | Magnie | 224/45 T |
| 4,023,762 | 5/1977 | Batts et al. | 223/85 X |

*Primary Examiner*—Stephen Marcus

*Attorney, Agent, or Firm*—Donald E. Hewson

[57] ABSTRACT

A support device for a plurality of garment hangers is disclosed and an operating handle member therefor. The support device includes a hook portion by which it can be hung from a standard traverse member in a shipping box and a bead formation by which the device can be lifted on engagement of the operating handle member with the bead formation. The device is particularly easily extruded from PVC, polycarbonate or polypropylene materials.

7 Claims, 2 Drawing Figures

RACK HANGING DEVICE FOR GARMENTS

BACKGROUND OF THE INVENTION

This present invention is concerned with improvements in or relating to support means for a plurality of hangers such as garment hangers. More particularly, the present invention is concerned with a support device for a plurality of hangers such as wire garment hangers, and is used for transporting the garments or other items suspended or otherwise supported by the hangers. This invention also provides an operating handle member for the rack hanging device.

Particularly in the transport of garments, there arises the need for a support means or rack hanging device for arranging thereon a plurality of garments by means of conventional garment hangers, e.g., the wire type variety of garment hangers. The support means must be adaptable to be positioned in containers, most especially the boxes of transport trailers, for the protection of the garments. Normally, the garments have considerable weight and, customarily, wire devices have been provided, either with suitable handle means for securing the support means in the containers, or the support means are secured with removable handle means. In any event, the use of wire support devices adds a considerable weight to the payload of a shipment of garments from one place to another; but, more importantly, the weight of such wire or metal devices is excessive during return of the particular freight-carrying means.

A number of proposals have been made in the prior art literature. Thus, U.S. Pat. No. 3,160,279 of Hovey, issued Dec. 8, 1964, discloses an article supporting hanger for supporting one or more ladies' purses of the type provided with looped carrying straps. According to the proposal by Hovey, a plurality of hooks is supported by an oval-shape frame which is laterally movable between a retracted position and an extended position relative to a guide means from the frame. Such arrangement is, of course, useful for permanent storage such as storage of ladies' handbags. Such arrangement is not suitable for heavy-duty applications such as long distance transport of heavy garments.

U.S. Pat. No. 3,179,256 of Underwood, issued Apr. 20, 1965, is concerned with a supporting bracket for multiple clothes hangers. Underwood discloses a support bar for a plurality of clothes hangers, which bar is supported by two hooked hanger straps, swingably mounted by the support bar. The hanger straps are adapted to support the support bar when hooked to a molding and secured by a bolt and nut assembly. The device in accordance with the Underwood teaching is particularly useful for ironed garments and, due to its central support by the hanger straps, requires a fairly stiff support bar. Again, the proposal by Underwood is not of particular value in the transport of garments, since very robust securement would be required to avoid loosening of the swingable hanger straps and tilting of the support bar and, ultimately, the falling off of garments from the support bar.

U.S. Pat. No. 3,212,647 of Meyer et al, issued Oct. 19, 1965, discloses a multiple clothers hanger comprised of a hook member from which can be suspended a longitudinal body, to hang freely in the direction of its longitudinal axis and from which body a number of hangers can be suspended. The design of Meyer et al is also not suitable to perform the heavy-duty functions required in the transport of a plurality of garments, because the swivel arrangement thereof will tend to become worn relatively quickly, leading to eventual disengagement of the longitudinal body after repeated use.

U.S. Pat. No. 3,731,809 of Saenger, issued May 8, 1973, is concerned with a hanger assembly for supporting a plurality of clothers hangers comprising a hanger bar having a plurality of hook receiving apertures and a rectangular open interior handle with a hook mounted to the handle, so as to be completely nested within the contour of the handle when the assembly is to be carried by hand. As has been indicated in the foregoing, the use of pivoting or swingable members is not desirable in support devices for transporting of a plurality of garments and, accordingly, the teaching of Saenger does not provide a useful advance in such devices.

U.S. Pat. Nos. 3,633,801 and 3,799,416 of Bonasso and Schmaltz, issued Jan. 11, 1972 and Mar. 26, 1974, respectively, disclose C-shaped handle members for carrying garment hangers. The handle members of Bonasso and Schmaltz facilitate the carrying of one or two garment hangers and are shaped so as to readily be supported by a closet pole or on a supporting surface. The handle members of Bonasso and Schmaltz facilitate the carrying of one or two garment hangers and are shaped so as to readily be supported by a closet pole or on a supporting surface. The handle members of Bonasso and Schmaltz do not permit the storage thereof during transport of a multiplicity of garments in a moving vehicle or the like transporting means.

Accordingly, the prior art has failed to provide a suitable device for transporting a plurality of garments or the like articles, which device is lightweight, yet effective for its intended purpose and which is readily positioned with its load on a transverse member.

SUMMARY OF THE INVENTION

It is an object of the present invention to provide a support device for a plurality of hangers such as garment hangers, and which may be readily produced by injection molding of a suitable plastics material.

It is also the object of the present invention to provide a support device for a plurality of hangers such as garment hangers, which requires less storage space and labour in sorting after use.

It is also an object of the present invention to provide an operating handle member for positioning the support device on a transverse member.

In accordance with the present invention there is provided a device for supporting a plurality of hangers such as garment hangers which comprises a channel section for pendently supporting the support device on a transverse member, said channel section having at least one extended leg portion having at least one garment hanger receiving aperture therein, and a lifting lug formation on one side of the extended leg portion beneath the channel section, said lifting lug formation providing a longitudinal counter-bearing surface for an operating member to be engaged therewith.

Also in accordance with the present invention there is provided an operating handle member which comprises at least one hand grip member and transverse longitudinal bearing surface for engagement with the longitudinal counter-bearing surface of a support device as aforesaid.

Preferably, the support device is comprised on an injection molded plactics material.

The support device in accordance with the present invention provides for a number of important advantages. The support device is very lightweight since it can be readily molded using materials such as ABS, PVC, polycarbonates or polyethylene materials. The configuration of the support device lends itself to be closely stacked in sets, thus reducing the space required for storage and increasing the manageability thereof. Provision of a low cost, essentially non-returnable, support device substantially eliminates maintenance costs thereof. More particularly, the provision of an injection molded plastic rack hanging device, of lightweight and low initial cost, provides an option of disposal of the device or returning the device to its starting place for reuse, but at much lower cost because of the lower weight to be transported.

By eliminating wire-form devices, there has been a substantial labour saving in repair, as well as in the mere handling of the devices and disentangling them one from another.

The operating handle member in accordance with the present invention need not be an integral part of the support device and it will, thus, be sufficient to provide only a few of these at the loading and unloading points.

BRIEF DESCRIPTION OF THE DRAWINGS

Other objects and advantages of the present invention will become apparent from the following description of specific embodiment of the invention with reference to the accompanying drawings, in which.

DESCRIPTION OF THE PREFERRED EMBODIMENT

Figure 1:
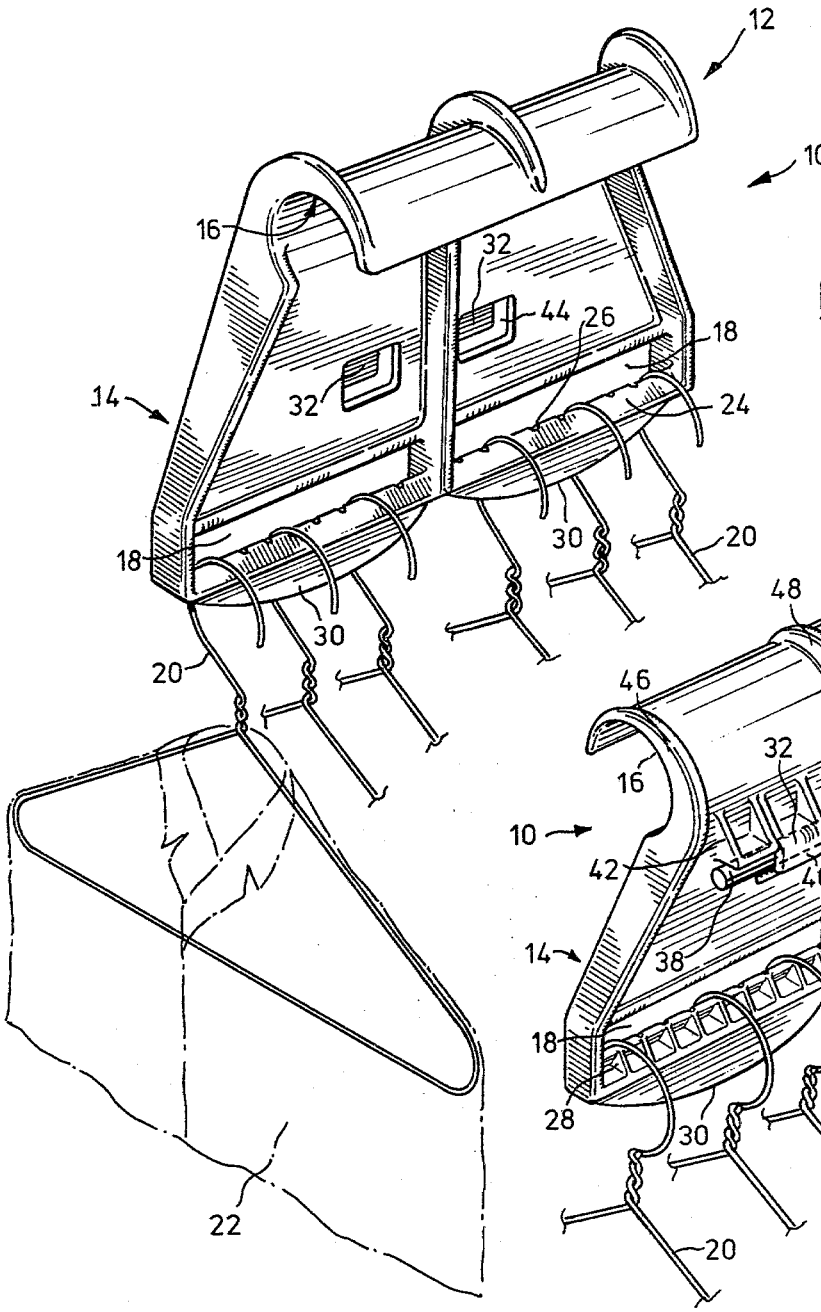
FIG. 1 is a perspective view from the rear side of a rack hanging device in accordance with the preferred embodiment of this invention, showing the device in co-operative relationship to a number of garment hangers being supported thereby.

As shown in the drawings, the rack hanging device for garments, according to the present invention, is comprised of a device 10 which is preferably formed of injection molded plastic, having an upper, channel portion 12, and a lower leg portion 14. In the upper channel portion there is a concave surface 16; and in the lower leg portion there is at least one aperture 18. In the preferred embodiment shown in the drawings, there are two apertures 18, each of which is adapted for supporting a plurality of garment hangers 20, or the like, on which some sort of garment 22 such as a suit, dress, shirt or coat may be placed by the manufacturer or shipper.

Depending on the nature, bulkiness and weight of the garments being shipped, as many as seven or eight garment hangers 20 may be accomodated in each of the apertures 18; and in all events, the garment hangers 20 are supported on the hanging bar 24 which may have a plurality of indentations or grooves 26 formed in its upper surface to accomodate the hook portion of the garment hangers 20.

So as to assure that the weight of the garment 22 on the garment hangers 20 will be supported without any appreciable deformation of the material of the rack hanging device 10, there are provided a plurality of stiffening ribs 28, each of substantially triangular configuration. Of course, the hanging bar 24 can be formed in a manner so that the profile of the hanging bar is substantially that of any one of the stiffening ribs 28—i.e., the hanging bar would be molded as a solid piece. This would provide additional cross-section and stiffness, but the stiffening ribs are generally sufficient, without the problems that are commensurate with having to cool and set a thicker cross-section of plastic which has been injection molded.

In any event, a pair of stiffening webs 30 may also be provided, beneath the hanging bars 24, and it will be noted that the profile of the stiffening webs 30 when viewed from either side of the rack hanging device 10 is such that the height of the web is greatest near the longitudinal center of the respective aperture 18.

In use, the rack hanging device 10 is placed over a suitable bar or rod which is accomodated by the profile of the concave surface 16 of the channel portion 12, defining a rearwardly and downwardly facing hook. The garment hangers 20 with their garments 22 are placed on the hanging bars 24; and the rack hanging device is then ready to be transferred to the container or van or transport trailer in which the garments and a great many other garments will be transported to another place from which they will be sold or transshipped to their place of sale. In any event, the present invention now provides a means whereby a plurality of hanging garments 22 can be moved at one time into and out of the container in which they are being shipped and, indeed, even up to the retail display racks from which the garments may be sold. It will be noted that at all times, the garments 22 are supported on their individual hangers 20, and thereby are not liable to creasing, crushing or other abusive handling as they may be if they were shipped flat in a crate or box, or the like.

Figure 2:
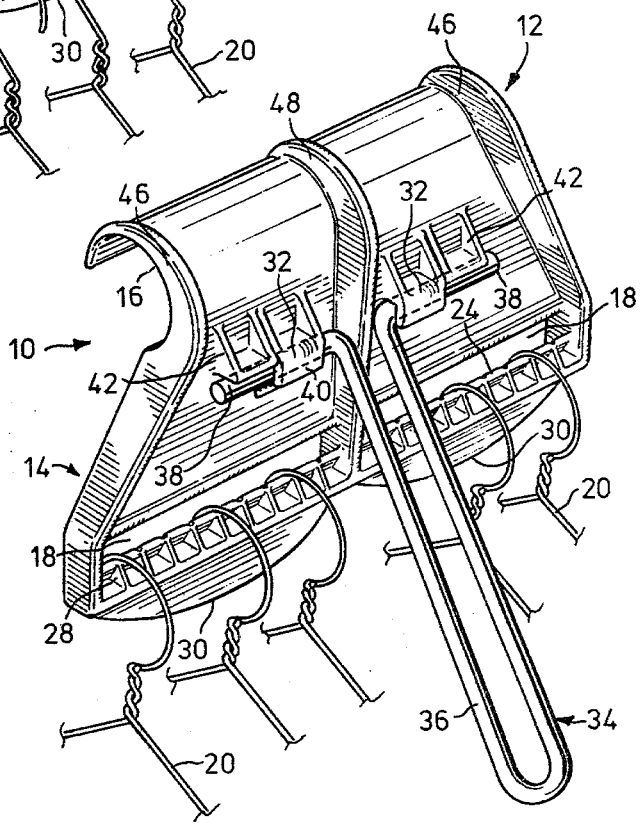
FIG. 2 is a perspective view from the front side of the device, showing the operating or lifting handle member in co-operation with the device.

So as to accomodate the transfer of a plurality of garments at one time, once the garments have been placed onto the rack hanging device 10, there is provided a pair of forwardly directed lifting lugs 32 on the front side of the leg portion 14 of the device 10. The underside of the lifting lugs 32 provides a counter-bearing surface for an operating handle 34 to be engaged therewith. The operating handle may be formed wire, or the like, and has a handle portion 36 and two extending lifting bar portions 38, as shown in FIG. 2.

So as to assure that the operating or lifting handle 34 does not slip away from the rack hanging device 10 when the rack hanging device 10 is being supported by the handle 34, a pair of downwardly directed flanges 40 are formed integrally with the lifting lugs 32; and the distance away from the front surface of the leg portion 14 wherein the flanges 40 are formed is just sufficient so as to accomodate the lifting bar portions 38 of the operating handle 34.

Once again, so as to accomodate the weight of the rack hanging device 10 and the garments supported thereby, the lifting lugs 32 are formed with a plurality of stiffening ribs 42, each of generally triangular configuration. The triangular configuration provides the required strength, with an economy of material. The apertures 14 which are formed in the leg portion 14 of the rack hanging device 10, behind the downturned lugs 40, accomodate removal of the device from the mold in which it has been injection molded.

There are a plurality of ribs which are formed, being the side ribs 46 and a center rib 48, all of which provide stiffness to the device and particularly the leg portion 14 thereof. So as to accomodate the center rib 48, the lifting lugs are formed in a manner so as to be discontinuous near the center of the device 10, and the handle portion 36 of the lifting handle 34 is formed in a bifurcated configuration.

It is known that, in the container in which the hanging garments may be shipped, particularly in the trailer portion of a tractor/trailer transport vehicle, the temperatures to which the rack hanging devices and the garments supported thereby may vary over an extreme range of temperatures—i.e., from well below 0° C. to 35° C. or more. Accordingly, the material from which the rack hanging device 10 is formed must be of a material which provides the sufficient rigidity and strength over the range of temperatures, particularly so as to accomodate the weight of the hanging garments supported thereby; and such material is advantageously acrylonitrilebutadiene styrene (ABS). Other materials which may be used include polyvinyl chloride, polycarbonates and polyethylene.

There has been described a rack handing device for garments or the like, which device is generally an injection molded plastic device, capable of supporting a plurality of garments each on their own respective garment hangers, and which may be moved by the co-operation of lifting lugs formed on the device with a lifting handle so that the plurality of garments may be moved at one time. Clearly, it is necessary to provide only one or a few lifting or operating handles 34, for use by the persons who are moving into and out of the container, trailer or the like for purposes of engaging or disengaging the rack hanging device from the bar or rod on which it is supported; and, clearly a great number of garments may be transported or shipped at one time, with a minimum cost in time and labour of packing or unpacking the garments from the container or trailer in which they are shipped. If, as is very often the case, the garments are geing shipped from one point to another and the container or trailer in which they have been shipped is then returned, empty, to the point of origin, then there is not a great burden of heavy rack hanging devices being transported, and additional fuel and energy costs, with the empty container or transport.

Other modifications to the configuration or other details of the rack hanging device may, of course, be incorporated therein, without departing from the spirit and scope of the appended claims.

The embodiments of the invention in which an exclusive property or privilege is claimed are:

1. A device for supporting a plurality of hangers such as garment hangers or the like, comprising:

a substantially planar lower leg portion having a front side and a rear side;

an upper channel portion for pendently supporting the device, and having a concave surface defining a rearwardly and downwardly facing hook;

said substantially planar leg portion having at least one aperture for a plurality of garment hangers or the like; and a lifting lug formation on the front side of said substantially planar lower leg portion beneath said rearwardly and downwardly facing hook, comprising at least one forwardly directed lug and at least one downwardly directed flange spaced at a distance from the front face of said substantially planar lower leg portion so as to provide a counterbearing surface for an operating member to be engaged therewith.

2. A device in accordance with claim 1, where said device is formed of a synthetic resinous material selected from the group consisting of ABS, PVC, polycarbonate and polyethylene.

3. A device as claimed in claim 1, wherein said device includes a pair of side ribs formed along opposed edges thereof, and a central rib formed centrally thereof, all of said ribs extending substantially for the entire height of said device.

4. A device as claimed in claim 1, wherein said device includes a pair of hanger receiving apertures, and a plurality of forwardly directed, triangular shaped stiffening ribs formed below said apertures.

5. A device as claimed in claim 4, wherein a pair of downwardly directed stiffening webs is formed substantially in the same plane as said lower leg portion and beneath said pair of hanger receiving apertures and said stiffening ribs.

6. A cdevice in accordance with claim 1, wherein said lifting lug formation comprises a pair of sideways spaced forwardly directed lugs and an associated pair of downwardly directed flanges.

7. A device as claimed in claim 6, wherein a plurality of forwardly directed, triangular-shaped stiffening ribs is formed above each of said forwardly directed lugs.

* * * * *